US006708681B2

(12) United States Patent
Hosoya et al.

(10) Patent No.: US 6,708,681 B2
(45) Date of Patent: Mar. 23, 2004

(54) METHOD AND DEVICE FOR FEEDBACK CONTROLLING AIR-FUEL RATIO OF INTERNAL COMBUSTION ENGINE

(75) Inventors: Hajime Hosoya, Atsugi (JP); Hidekazu Yoshizawa, Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 0 days.

(21) Appl. No.: 09/897,925

(22) Filed: Jul. 5, 2001

(65) Prior Publication Data

US 2002/0002970 A1 Jan. 10, 2002

(30) Foreign Application Priority Data

Jul. 7, 2000 (JP) ..... 2000-206772
Jul. 14, 2000 (JP) ..... 2000-214174

(51) Int. Cl.[7] ..... F02D 41/30; F02D 41/14

(52) U.S. Cl. ..... 123/681; 123/673; 123/704; 701/103; 701/109

(58) Field of Search ..... 123/672, 673, 123/676, 677, 679, 681, 703, 704, 691, 692; 701/103, 104, 109, 115; 60/285

(56) References Cited

U.S. PATENT DOCUMENTS 5,531,208 A * 7/1996 Hasegawa et al. ..... 123/673
5,566,071 A * 10/1996 Akazaki et al. ..... 123/672
5,623,913 A * 4/1997 Kitajima et al. ..... 123/673
5,636,621 A * 6/1997 Maki et al. ..... 123/480
5,657,737 A * 8/1997 Ishida et al. ..... 123/674
5,692,485 A * 12/1997 Maki et al. ..... 123/684
5,755,212 A * 5/1998 Ajima ..... 123/674
5,774,822 A * 6/1998 Maki et al. ..... 123/480
5,806,506 A * 9/1998 Kitamura et al. ..... 123/673
5,813,389 A * 9/1998 Kitamura et al. ..... 123/673
5,816,230 A * 10/1998 Kurokawa et al. ..... 123/674
5,887,570 A * 3/1999 Suzuki et al. ..... 123/406.44
5,947,096 A * 9/1999 Kurokawa et al. ..... 123/673

FOREIGN PATENT DOCUMENTS

JP 6-108091 4/1994
JP 232720 * 9/1996 ..... F02D/41/14
JP 73068 * 3/1998 ..... F02D/45/00
JP 200-8921 * 1/2000 ..... F02D/41/14

* cited by examiner

*Primary Examiner*—Henry C. Yuen
*Assistant Examiner*—Hai H. Huynh
(74) *Attorney, Agent, or Firm*—McDermott, Will & Emery

(57) ABSTRACT

An air-fuel ratio detected by an air-fuel ratio sensor is estimated based on an estimation value of air-fuel ratio of an air-fuel mixture formed inside a cylinder, and based on an air-fuel ratio estimated as being detected by this air-fuel ratio sensor and the air-fuel ratio detected based on an output signal of the air-fuel ratio sensor, the estimation value of the cylinder air-fuel ratio is corrected and a fuel injection quantity is corrected based on the corrected cylinder air-fuel ratio.

20 Claims, 8 Drawing Sheets

METHOD AND DEVICE FOR FEEDBACK CONTROLLING AIR-FUEL RATIO OF INTERNAL COMBUSTION ENGINE

FIELD OF THE INVENTION

The present invention relates to a method and device for feedback controlling an air-fuel ratio of an internal combustion engine, which controls an air-fuel ratio of a air-fuel mixture formed inside a cylinder of an engine, to a target air-fuel ratio.

RELATED ART OF THE INVENTION

Heretofore, there has been known an air-fuel ratio feedback control device of a construction which corrects a fuel injection quantity based on a deviation between an air-fuel ratio detected by an air-fuel ratio sensor provided in an exhaust pipe and a target air-fuel ratio, so that an air-fuel ratio of an air-fuel mixture formed inside a cylinder of an engine coincides with a target air-fuel ratio (refer to Japanese Unexamined Patent Publication No. 6-108901).

However, a dead time due to exhaust gas propagation occurs up until the correction result of the fuel injection quantity based on the air-fuel ratio detected by the air-fuel ratio sensor becomes detected by the air-fuel ratio sensor.

Therefore, if a feedback control is performed without taking this dead time into consideration, then overshoot occurs, and it is required to set a feedback gain that can maintain a response characteristic while suppressing the overshoot.

Therefore, conventionally an optimum gain is obtained beforehand for each engine intake air quantity and engine rotational speed correlated with the dead time, and this optimum gain is stored in a map, and the gain corresponding to the intake air quantity and the rotational speed at that time is retrieved from the map, to be used in the feedback control.

Consequently, conventionally a large amount of man-hour is required in order to perform the gain adaptation. Moreover, a large amount of storage capacity is necessary for the map to store the gain for each operating condition. Furthermore, there is a problem in that in order to avoid overshoot, it is not possible to feedback control the air-fuel ratio at a high response characteristic.

SUMMARY OF THE INVENTION

The present invention takes into consideration the above problems, with an object of enabling correction of air-fuel ratio at a high response characteristic without needing to set a gain corresponding to a dead time, by providing a method and device for feedback controlling an air-fuel ratio of an internal combustion engine, which accurately estimates an air-fuel ratio of an air-fuel mixture formed inside a cylinder of an engine and feedback controls a fuel injection quantity from the estimation result.

In order to achieve the above object, the present invention is constructed such that an air-fuel ratio of an air-fuel mixture formed inside a cylinder is estimated, and an air-fuel ratio correction amount for correcting a fuel injection quantity is computed based on the estimated cylinder air-fuel ratio, while an air-fuel ratio to be detected by an air-fuel ratio sensor installed in an exhaust pipe is estimated based on the estimated cylinder air-fuel ratio, and the estimated cylinder air-fuel ratio is corrected based on the air-fuel ratio estimated to be detected by this air-fuel ratio sensor and an air-fuel ratio detected by the air-fuel ratio sensor.

With such a construction, the cylinder air-fuel ratio is estimated and the fuel injection quantity is feedback controlled so that the estimated cylinder air-fuel ratio coincides with a target air-fuel ratio, while the air-fuel ratio to be detected by the air-fuel ratio sensor is estimated based on the fact that the estimated cylinder air-fuel ratio is belatedly detected by the air-fuel ratio sensor, and from this estimation value and the air-fuel ratio actually detected by the air-fuel ratio sensor, an estimation error for the cylinder air-fuel ratio is corrected.

The other objects and features of this invention will become understood from the following description with reference to the accompanying drawings.

PREFERRED EMBODIMENTS

Figure 1:
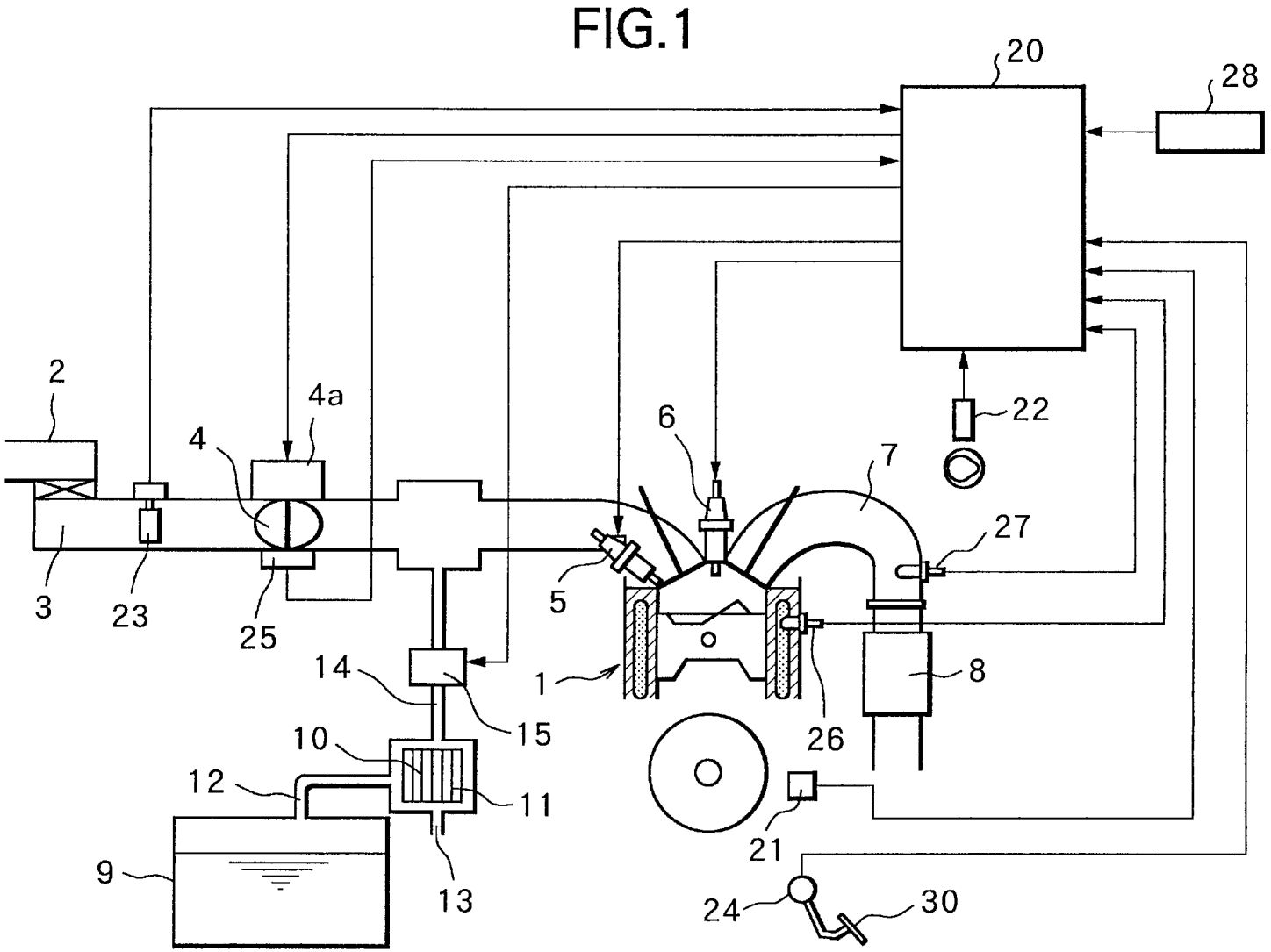
FIG. 1 is a system configuration diagram of an internal combustion engine.

FIG. 1 is a system configuration diagram of an internal combustion engine according to an embodiment.

In FIG. 1, air is drawn into a combustion chamber of each cylinder of an internal combustion engine 1 mounted on a vehicle, via an air cleaner 2, an intake pipe 3, and an electronically controlled throttle valve 4 which is driven to open or close by a motor 4*a*.

Each cylinder is provided with an electromagnetic type fuel injection valve 5 for directly injecting fuel (gasoline) to inside the cylinder. An air-fuel mixture is formed with the fuel injected from the fuel injection valve 5 and the air drawn into the cylinder, and this air-fuel mixture is ignited to burn by spark ignition from an ignition plug 6.

The fuel injection valve 5 is opened with the power supply to a solenoid thereof by an injection pulse signal output from a control unit 20, to inject fuel adjusted to a predetermined pressure.

However, the internal combustion engine 1 is not limited to the abovementioned direct injection type gasoline engine, and an engine of a construction where fuel is injected into an intake port is also possible.

Exhaust gas from the engine 1 is discharged from an exhaust pipe 7. A catalytic converter 8 for exhaust emission control is installed in the exhaust pipe 7.

Furthermore, there is provided a fuel vapor treatment device for combustion processing fuel vapor generated in a fuel tank 9.

A canister 10 is a sealed container filled with an adsorbent 11 such as activated carbon, to which a fuel vapor introduction pipe 12 extending from the fuel tank 9 is connected. Consequently, fuel vapor generated in the fuel tank 9 passes through the fuel vapor introduction pipe 12 and is introduced to the canister 10 to be adsorbed and collected.

Furthermore, a fresh air inlet 13 is formed in the canister 10, while a purge pipe 14 leads out from the canister 10. In the purge pipe 14 is installed a purge control valve 15 which is controlled to open or close by a control signal from the control unit 20.

According to the above construction, when the purge control valve 15 is controlled to open, as a result that the negative intake pressure of the engine 1 acts on the canister 10, the fuel vapor adsorbed in the adsorbent 11 of the canister 10 is purged by the air introduced from the fresh air inlet 13, and the purge air passes through the purge pipe 14 and is drawn into downstream of the throttle valve 4 of the intake pipe 3, after which the purge air is treated to be combusted in the engine 1.

The control unit 20 is provided with a microcomputer comprising a CPU, ROM, RAM, A/D converter, input/output interface and so forth, and receives input signals from various sensors, and based on these input signals, performs computation processing to control the operations of the fuel injection valve 5, the ignition plug 6, the purge control valve 15 and so on.

For the various sensors, there is provided a crank angle sensor 21 for detecting a crank angle of the engine 1, and a cam sensor 22 for taking out a cylinder discrimination signal from a camshaft. A rotational speed Ne of the engine is computed based on a signal from the crank angle sensor 21.

In addition, there is provided; an air flow meter 23 for detecting an intake air flow Q (mass flow rate) at an upstream side of the throttle valve 4 of the intake pipe 3, an accelerator sensor 24 for detecting a pedal amount (accelerator opening) APS of an accelerator pedal 30, a throttle sensor 25 for detecting a throttle valve opening TVO of the throttle valve 4, a water temperature sensor 26 for detecting cooling water temperature Tw of the engine 1, a wide range type air-fuel ratio sensor 27 disposed on an upstream side of the catalytic converter 8 in the exhaust pipe 7, for detecting an air-fuel ratio (A/F) of the burnt air-fuel mixture corresponding to oxygen concentration in the exhaust gas, and a speed sensor 28 for detecting a vehicle speed VSP.

Figure 2:
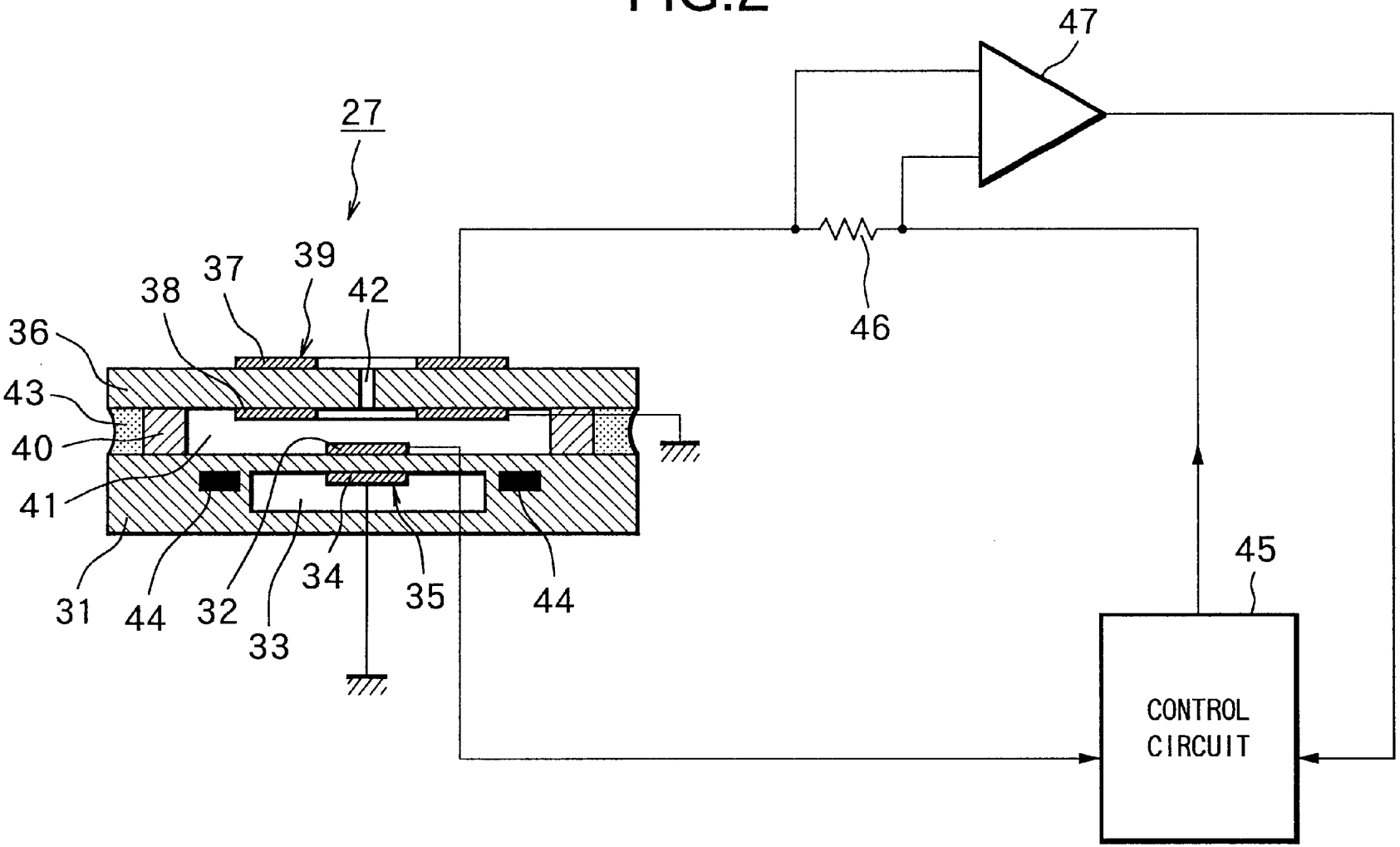
FIG. 2 is a diagram showing an air-fuel ratio sensor and peripheral circuits thereof.

Here, the construction of the wide range type air-fuel ratio sensor 27 will be explained based on FIG. 2.

On a substrate 31 comprising a solid electrolyte material such as Zirconia (ZrO2) is provided a positive electrode 32 for oxygen concentration measurement. Furthermore, inside the substrate 31 is provided a cavity 33 to which the atmosphere is introduced. On a ceiling portion of this cavity 33 a negative electrode 34 is attached so as to face the positive electrode 32 with the substrate 31 therebetween. Thus, the substrate 31, the positive electrode 32, and the negative electrode 34 constitute an oxygen concentration detection unit 35.

Furthermore, the air-fuel ratio sensor 27 has an oxygen pump unit 39 formed by providing a pair of pump electrodes 37 and 38 comprising platinum, on opposite sides of a solid electrolyte material 36 comprising Zirconia or the like.

The oxygen pump unit 39 is then laid on the oxygen concentration detection unit 35 via a spacer 40 formed in a frame shape from for example alumina, to form a hollow chamber 41 between the oxygen concentration detection unit 35 and the oxygen pump unit 39, and further an introduction hole 42 for introducing exhaust gas from the engine to the hollow chamber 41, is formed on the solid electrolyte material 36 of the oxygen pump unit 39.

A glass adhesive 43 is filled around the outer periphery of the spacer 40, so that sealing performance of the hollow chamber 41 is ensured, and also so that the substrate 31 and the spacer 40, and the solid electrolyte material 36 are adhered and secured. Here since the spacer 40 and the substrate 31 are baked and connected at the same time, the sealing performance of the hollow chamber 41 is ensured by adhering the spacer 40 to the solid electrolyte material 36. Furthermore, a heater 44 is built into the oxygen concentration detection unit 35.

The oxygen concentration of exhaust gas introduced to the hollow chamber 41 via the introduction hole 42 is detected based on a voltage of the positive electrode 32. More specifically, oxygen ions flow inside the substrate 31 depending on a concentration difference between the oxygen in the atmosphere inside the cavity 33 and the oxygen in the exhaust gas inside the hollow chamber 41, and according to this, an electromotive force corresponding to the oxygen concentration in the exhaust gas is generated at the positive electrode 32.

Moreover, a current value to be flown to the oxygen pump unit 39 is controlled in accordance with the detection result, so as to keep the atmosphere inside the hollow chamber 41 constant (for example at the theoretical air-fuel ratio), and the oxygen concentration in the exhaust is thus detected based on the current value at this time.

More specifically, the voltage of the positive electrode 32 is subjected to amplification by a control circuit 45 and then applied between the electrodes 37 and 38 via a voltage detecting resistor 46, so as to keep the oxygen concentration inside the hollow chamber 41 constant.

For example, in the case of detecting an air-fuel ratio in the lean region where the oxygen concentration in the exhaust gas is high, a voltage is applied with the pump electrode 37 on the outside being an anode and the pump electrode 38 on the side of the hollow chamber 41 being a cathode. Then, oxygen in proportion to the current (oxygen ions $O^{2-}$) is pumped out from the hollow chamber 41 to the outside. Then, when the applied voltage becomes a predetermined value or above, the flowing current reaches a limit value, and by measuring this limiting current value with the control circuit 45, the oxygen concentration in the exhaust gas, in other words the air-fuel ratio of the burnt air-fuel mixture can be detected.

Conversely, if the pump electrode 37 is made the cathode and the pump electrode 38 is made the anode so as to draw oxygen into the hollow chamber 41, the air-fuel ratio detection can be performed in the air-fuel ratio rich region where the oxygen concentration in the exhaust gas is low.

The limiting current is detected based on the output voltage of a differential amplifier 47 for detecting an inter-terminal voltage of the voltage detecting resistor 46.

The control unit 20, when the air-fuel ratio feedback control conditions are materialized, feedback controls a fuel injection quantity so that the air-fuel ratio of the burnt air-fuel mixture coincides with a target air-fuel ratio.

Figure 3:
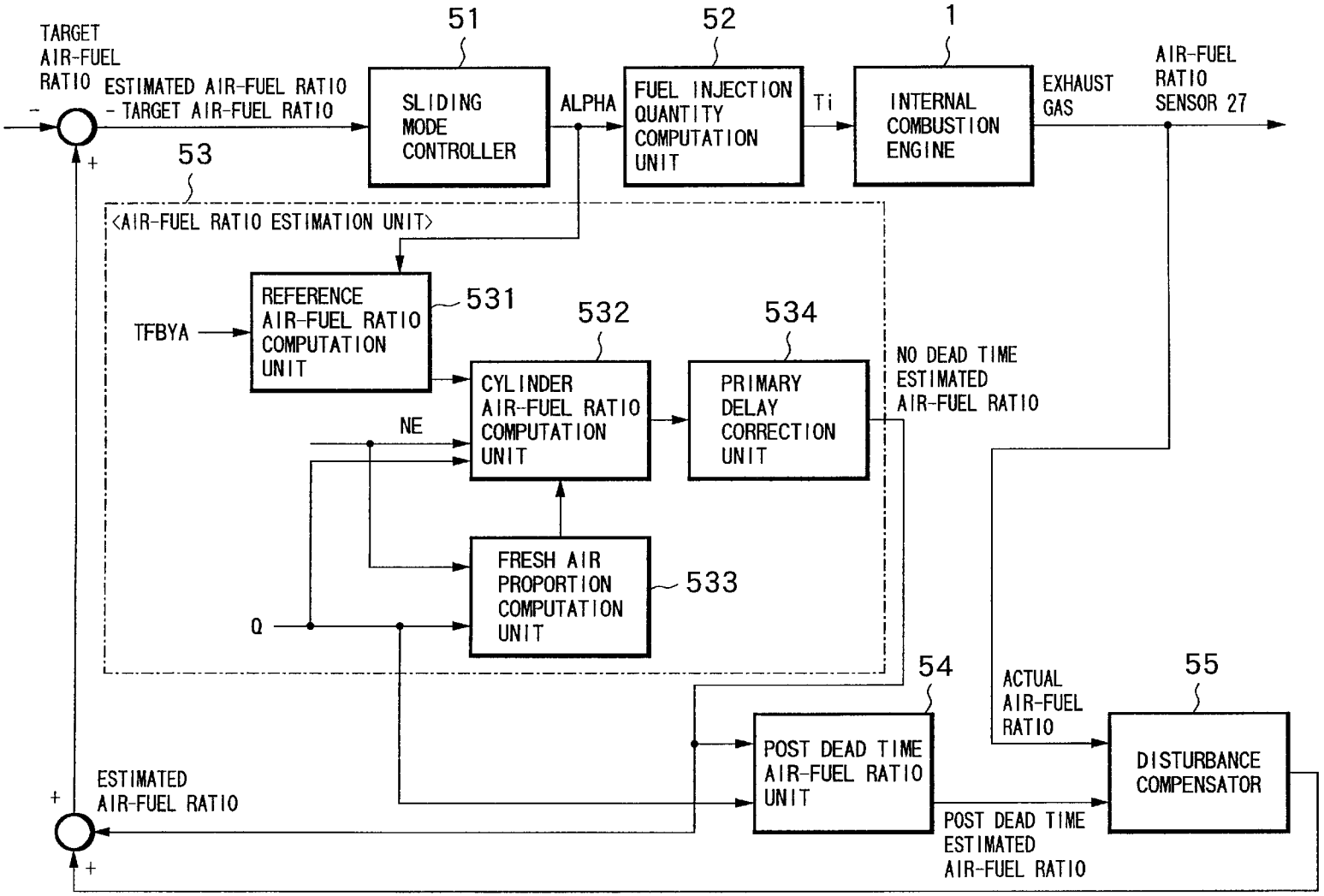
FIG. 3 is a block diagram showing the construction of an air-fuel ratio feedback control.

The block diagram of FIG. 3 shows the air-fuel ratio feedback control. A sliding mode controller 51 receives a deviation (error) between an estimated air-fuel ratio computed as described later and the target air-fuel ratio is input, and outputs, based on this deviation, an air-fuel ratio feedback correction coefficient ALPHA (air-fuel ratio correction value) for correcting the fuel injection quantity.

The air-fuel ratio feedback correction coefficient ALPHA is input to a fuel injection quantity computation unit 52, wherein a basic fuel injection quantity is corrected by the air-fuel ratio feedback correction coefficient ALPHA, to compute a final fuel injection quantity Ti, and an injection pulse signal of a pulse width corresponding to this fuel injection quantity Ti is output to the fuel injection valve 5 of the engine 1.

Figure 4:
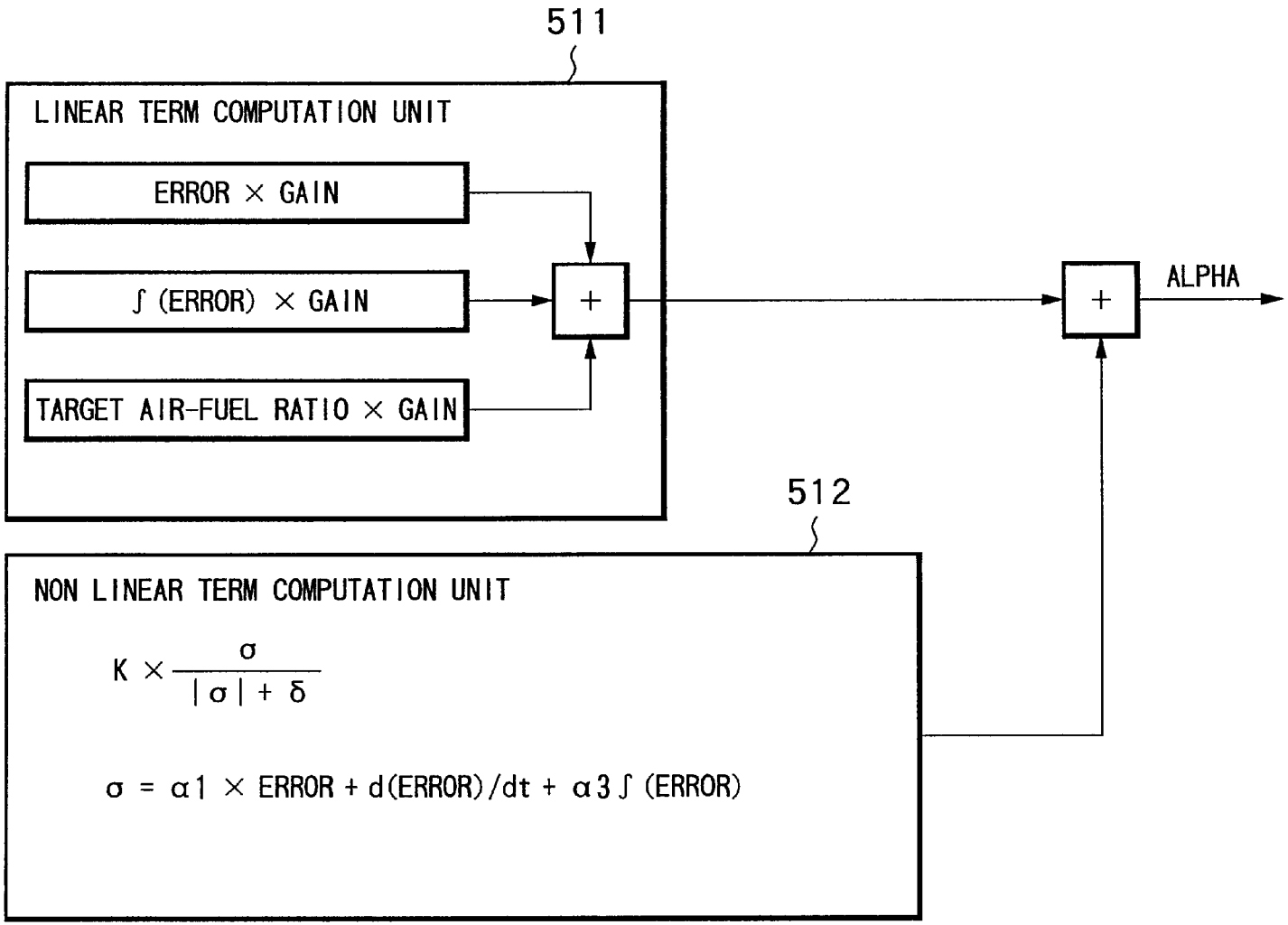
FIG. 4 is a block diagram showing a sliding mode controller.

FIG. 4 is a block diagram showing details of the sliding mode controller 51. The sliding mode controller 51 comprises a linear term computation unit 511 for computing a linear term U1 based on the deviation and a non linear term computation unit 512 for computing a non linear term U2 based on the deviation, and outputs the air-fuel ratio feedback correction coefficient ALPHA as the linear term U1+the non linear term U2=ALPHA.

The linear term computation unit 511 computes error× gain, ∫(error)×gain, and target air-fuel ratio×gain, respectively, and sums these computation results to compute the linear term U1. In more detail, with the error as x1 αi, ai, b (i:1,2,3) as coefficients, and r as the target air-fuel ratio, the linear term U1 is computed as:

$$U1=1/b((a0-\alpha 3\alpha 1(a1-\alpha 1))x1-\alpha 3(a1-\alpha 1)\int(x1)+a0r).$$

On the other hand, the non linear term computation unit 512, with a switching function as σ, a chattering prevention coefficient as δ, and a coefficient as K, computes the non linear term U2 as:

$$\sigma=\alpha 1\cdot x1+d(x1)/dt+\alpha 3\int(x1)$$

$$U2=K\cdot\sigma/(|\sigma|+\delta).$$

Further, the construction may be such that the air-fuel ratio feedback correction coefficient ALPHA is computed in accordance with a general proportional-integral-derivative operation. In this case, with a proportional gain as Kp, an integral gain as Ki, and a derivative gain as Kd, the air-fuel ratio feedback correction coefficient ALPHA is computed as:

$$\text{ALPHA}=Kp\cdot x1+Ki\cdot\int(x1)+Kd\cdot d(x1)/dt.$$

Moreover, the construction may be such that the air-fuel ratio feedback correction coefficient ALPHA is computed by a sliding mode control of a different construction to that shown in FIG. 4. Provided the construction is such that the air-fuel ratio feedback correction coefficient ALPHA is computed so that the estimated air-fuel ratio approaches the target air-fuel ratio, any kind of known construction may be applied.

On the other hand, as a construction for computing the estimated air-fuel ratio used in computation of the air-fuel ratio deviation, there is provided an air-fuel ratio estimation unit 53, a post dead time air-fuel ratio estimation unit 54 and a disturbance compensator 55.

Figure 5:
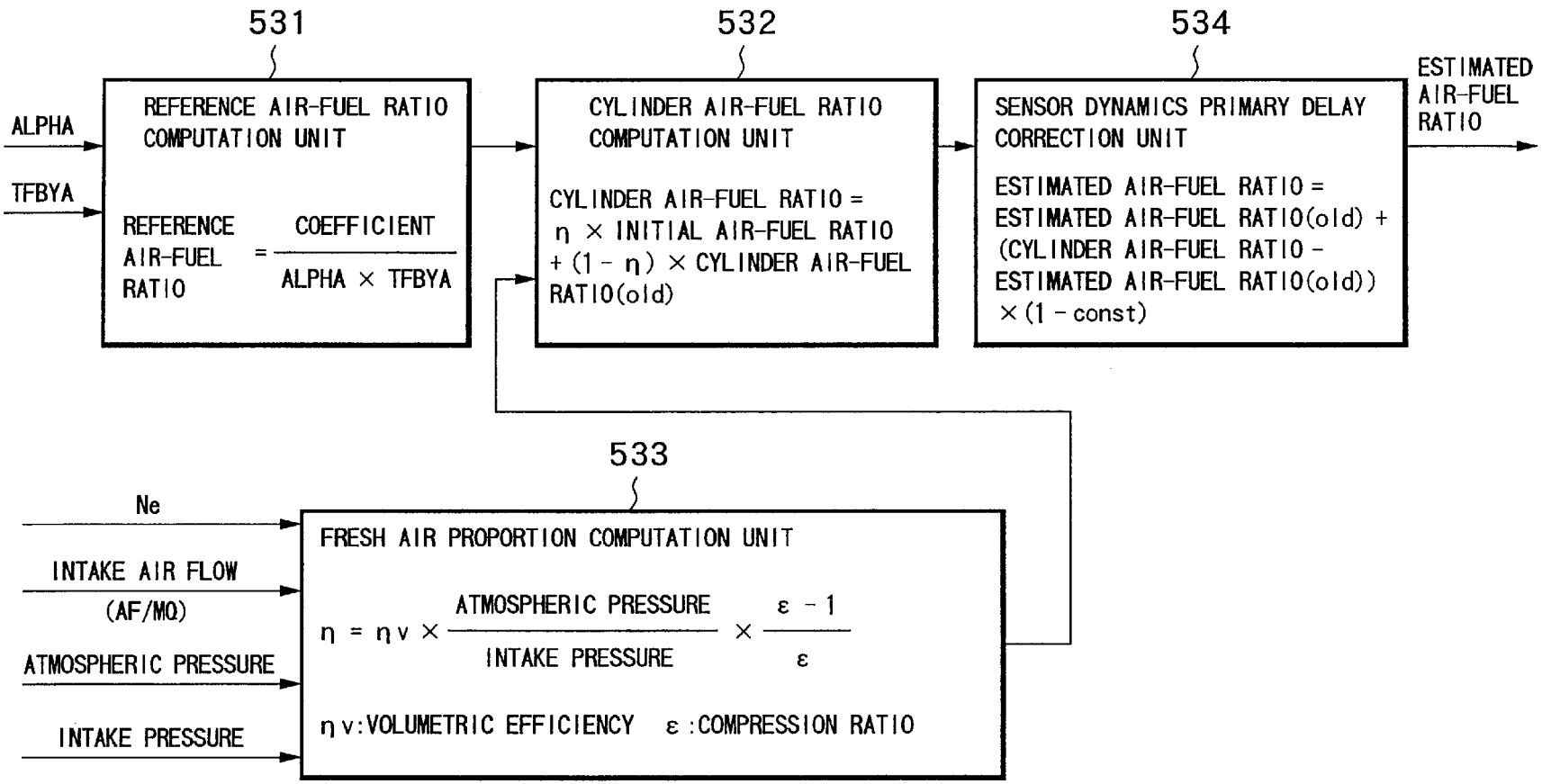
FIG. 5 is a block diagram showing an air-fuel ratio estimation unit.

FIG. 5 shows details of the air-fuel ratio estimation unit 53. The air-fuel ratio feedback correction coefficient ALPHA and a target equivalence ratio TFBYA are input to a reference air-fuel ratio computation unit 531, and a reference air-fuel ratio is computed as:

Reference air-fuel ratio=coefficient/(ALPHA×TFBYA).

Since the fuel injection quantity is computed as the injection quantity corresponding to the theoretical air-fuel ratio×TFBYA×ALPHA, then ALPHA×TFBYA becomes the equivalence ratio in the computation of the fuel injection quantity, and the inverse of this equivalence ratio is multiplied by the coefficient to be converted to the reference air-fuel ratio.

The reference air-fuel ratio is input to a cylinder air-fuel ratio computation unit 532, wherein the cylinder air-fuel ratio is computed in accordance with the following equation, based on a fresh air proportion η at that time and the reference air-fuel ratio:

Cylinder air-fuel ratio=η×reference air-fuel ratio+(1−η)×cylinder air-fuel ratio (old).

The fresh air proportion η is computed by a fresh air proportion computation unit 533.

The engine rotational speed Ne, the intake air flow detected by the air flow meter 23, the atmospheric pressure, and the intake pressure are input to the fresh air proportion computation unit 533, and the fresh air proportion ηis computed according to the following equation:

$$\eta=\eta v\times(\textit{atmospheric pressure}/\textit{intake pressure})\times((\epsilon-1)/\epsilon).$$

Here ηv is the volumetric efficiency, which is set based on the engine rotational speed Ne and the intake air flow. Moreover, ε is the compression ratio.

Further, the construction may be such that there are provided sensors for respectively detecting the atmospheric pressure and the intake pressure. Moreover, it is also possible to estimate these pressures from the operating conditions.

The cylinder air-fuel ratio computed by the cylinder air-fuel ratio computation unit 532 is input to a primary delay correction unit 534.

The primary delay correction unit 534 estimates the air-fuel ratio detected by the air-fuel ratio sensor 27 for a case where the cylinder air-fuel ratio is detected by the air-fuel ratio sensor 27, in other words for a case where it is assumed that the air-fuel ratio sensor 27 is installed in the cylinder.

Since the air-fuel ratio sensor 27 has a dynamic characteristic which responds with a primary delay to changes in the oxygen concentration (air-fuel ratio), then the primary delay correction unit 534 performs a primary delay correction on the cylinder air-fuel ratio, and sets this as the detection result for a case where the cylinder air-fuel ratio is detected by the air-fuel ratio sensor 27.

More specifically, if the estimation value of the air-fuel ratio detected by the air-fuel ratio sensor 27 is made the estimated air-fuel ratio, the estimated air-fuel ratio is computed as:

Estimated air-fuel ratio=estimated air-fuel ratio (old)+(cylinder air-fuel ratio−estimated air-fuel ratio (old))×(1−constant).

Since the estimated air-fuel ratio computed by the primary delay correction unit 534 is an estimation of an air-fuel ratio for a condition where there is no exhaust gas propagation delay (dead time), if the construction is such that the air-fuel ratio feedback control (computation of the correction coefficient ALPHA in the sliding mode controller 51) is performed based on this estimated air-fuel ratio, then adaptation and storage for the gain for corresponding to changes in the dead time becomes unnecessary, and correction can be performed at a high response.

However, since this estimated air-fuel ratio is shifted from an actual air-fuel ratio due to an influence of disturbance, this estimated air-fuel ratio is corrected using the air-fuel ratio sensor 27. More specifically, this correction is performed with the post dead time air-fuel ratio estimation unit 54 and the disturbance compensator 55.

Figure 6:
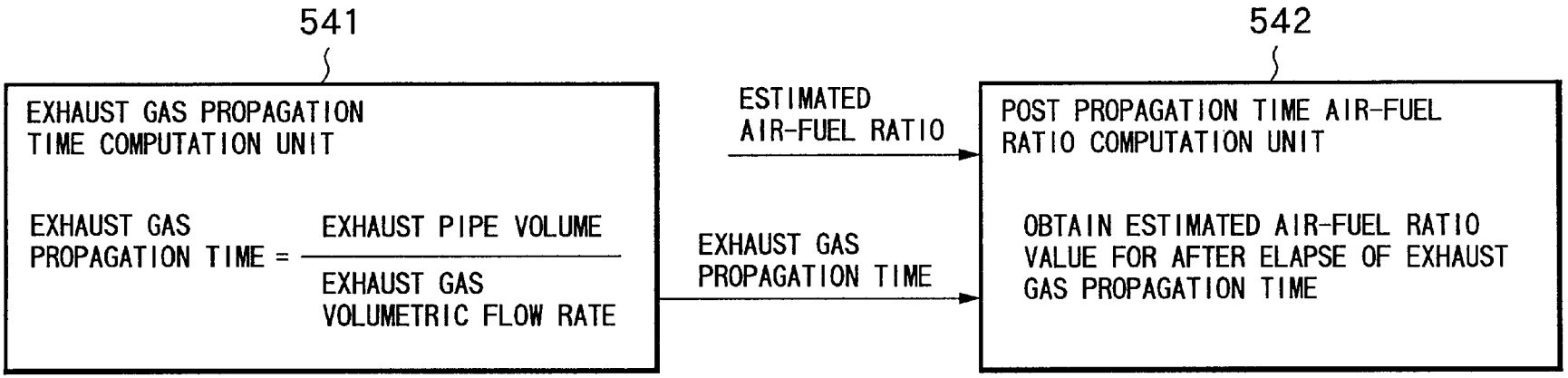
FIG. 6 is a block diagram showing a post dead time air-fuel ratio estimation unit.

The post dead time air-fuel ratio estimation unit 54, as shown in FIG. 6, comprises an exhaust gas propagation time computation unit 541 and a post propagation time air-fuel ratio computation unit 542.

The exhaust gas propagation time computation unit 541 computes the exhaust gas propagation time based on the exhaust pipe volume from the cylinder to the air-fuel ratio sensor 27, and the exhaust gas volumetric flow rate, as:

exhaust gas propagation time=exhaust pipe volume/exhaust gas volumetric flow rate.

Here, since the exhaust pipe volume is a fixed value, this is pre-stored. Furthermore, regarding the exhaust gas volumetric flow rate, the mass flow rate of the intake air detected by the air flow meter 23 is assumed to be the mass flow rate of the exhaust gas, and the volumetric flow rate is computed based on the exhaust gas mass flow rate and the exhaust temperature.

The post propagation time air-fuel ratio computation unit 542 stores the estimated air-fuel ratios computed by the primary delay correction unit 534 within a past predetermined time in a time series, and retrieves from data for a plurality of estimated air-fuel ratios stored in this time series, data for the estimated air-fuel ratio prior to the lapse of the exhaust gas propagation time, and outputs this as a post propagation time air-fuel ratio.

That is to say, the estimated air-fuel ratio computed by the primary delay correction unit 534 is the cylinder air-fuel ratio, and the exhaust gas of this air-fuel ratio reaches the air-fuel ratio sensor after the exhaust gas propagation time has elapsed. Hence the air-fuel ratio detected by the air-fuel ratio sensor 27 at the current time becomes the cylinder air-fuel ratio prior to the lapse of the exhaust gas propagation time.

The post propagation time air-fuel ratio is input to the disturbance compensator 55 together with the air-fuel ratio detected by the air-fuel ratio sensor 27, and in the disturbance compensator 55, a deviation between the air-fuel ratio detected by the air-fuel ratio sensor 27 and the post propagation time air-fuel ratio is input to a previously set transfer function, and an output of the disturbance compensator 55 is output as a correction value (disturbance correction value) for the estimated air-fuel ratio.

The deviation between the air-fuel ratio detected by the air-fuel ratio sensor 27 and the post propagation time air-fuel ratio shows an error in the post exhaust gas propagation time air-fuel ratio. However, since it is necessary to correct the estimated air-fuel ratio being the cylinder air-fuel ratio, the transfer function is previously system identified so that the estimated air-fuel ratio being the cylinder air-fuel ratio is appropriately corrected based on this deviation.

The output from the disturbance compensator 55 is added to the estimated air-fuel ratio output from the primary delay correction unit 534, and based on the deviation between the estimated air-fuel ratio corrected by this addition and the target air-fuel ratio, the air-fuel ratio feedback correction coefficient ALPHA is computed. Consequently, the occurrence of a large error in the estimated air-fuel ratio due to disturbances can be prevented, so that the feedback control to the target air-fuel ratio is possible at a high accuracy.

With the above embodiment, the construction is such that the deviation with respect to the target air-fuel ratio is obtained after the estimated air-fuel ratio has been corrected by the output from the disturbance compensator 55. However, if for example, the target air-fuel ratio is corrected by the output from the disturbance compensator 55, and the deviation between the target air-fuel ratio after this correction and the estimated air-fuel ratio is computed, there is no substantial difference.

Next is a description of a second embodiment of the post dead time air-fuel ratio estimation unit 54.

In the second embodiment, it is previously obtained what times x an air-fuel ratio control period Tj (for example 10 msec) is a maximum propagation delay time Tmax (the propagation delay time during idling) from the cylinder to the air-fuel ratio sensor 27(x=Tmax/Tj), and x memories (memory regions) are secured as memories for storing the estimated air-fuel ratios.

Furthermore, by dividing the exhaust pipe volume Vex from the cylinder to the air-fuel ratio sensor 27 by the multiple x, a divided pipe volume Vx(Vx=Vex/x) corresponding to each memory is obtained.

Then, each of the x memories is assigned to each volume portion for the case where it is assumed that the exhaust pipe volume Vex is divided into x along the flow direction of the exhaust gas from the cylinder side towards the air-fuel ratio sensor 27.

Figure 7:
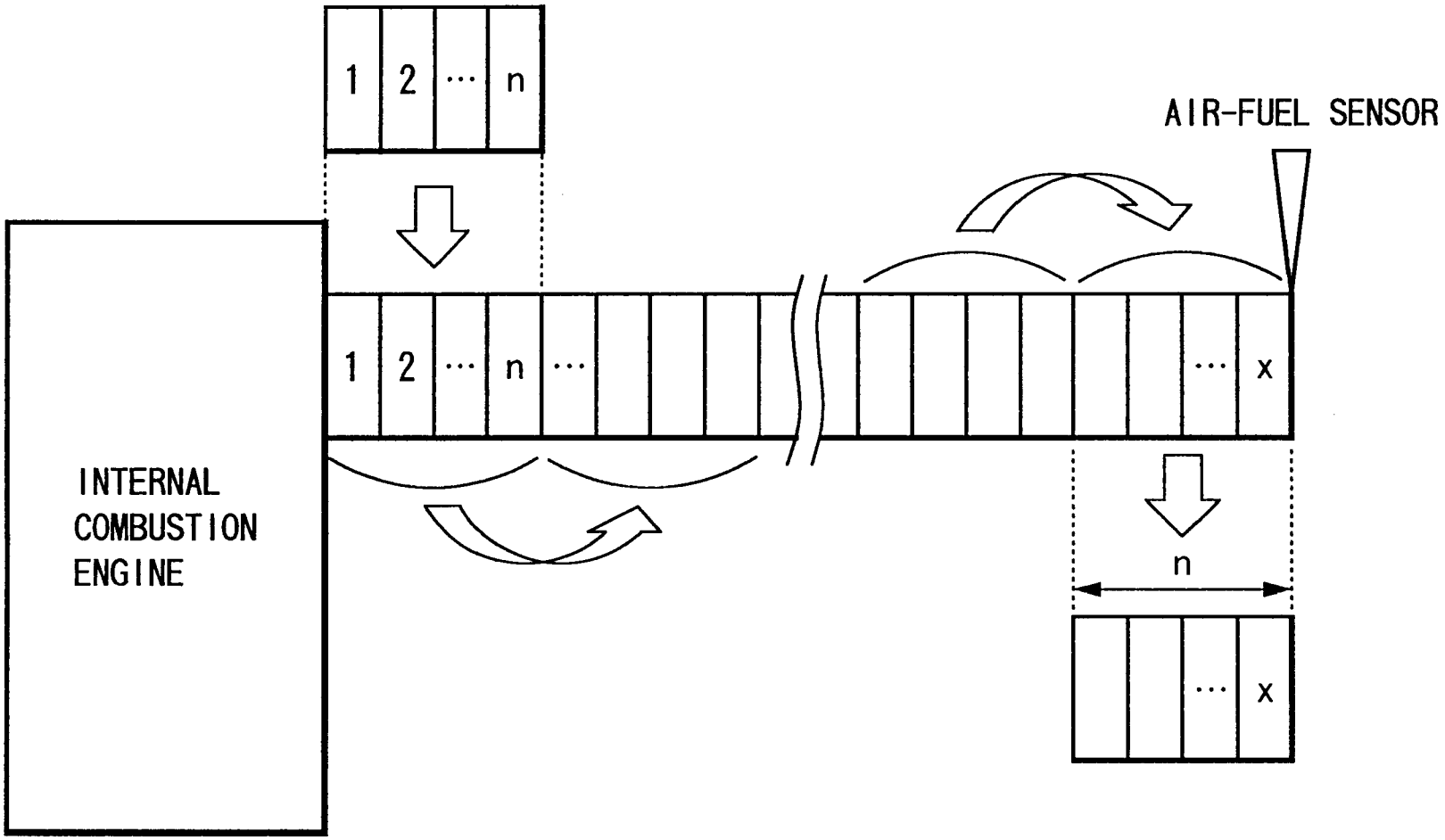
FIG. 7 is a conceptual diagram showing a memory configuration used in another embodiment of a post dead time air-fuel ratio estimation unit.

As a result, there is provided a plurality of memories which store the estimated air-fuel ratios (cylinder air-fuel ratios) respectively corresponding to each of the divided volume portions for when the exhaust pipe volume is virtually multiply divided from the cylinder to the air-fuel ratio sensor 27 along the flow direction of the exhaust gas (refer to FIG. 7).

Then, for each air-fuel ratio control period, the volume of exhaust gas discharged during this interval is obtained, and an average value of the estimated air-fuel ratios computed during this interval is obtained. Moreover, it is computed how many portions (=n) of the divided pipe volume Vx, the exhaust gas volume is equivalent to, and this average value of the estimated air-fuel ratios is stored in n memories from the upstream end.

At this time, the data for the estimated air-fuel ratio stored up to the previous time, is shifted by n to the downstream side, and sequentially sent to the memory corresponding to the further downstream side and stored. The result of this sequential sending is such that the estimated air-fuel ratios stored in the n memories from the downstream end are pushed out from the memories, and an average value of these pushed out n estimated air-fuel ratios is estimated as a value (post dead time estimated air-fuel ratio) detected by the air-fuel ratio sensor 27 at that time.

Figure 8:
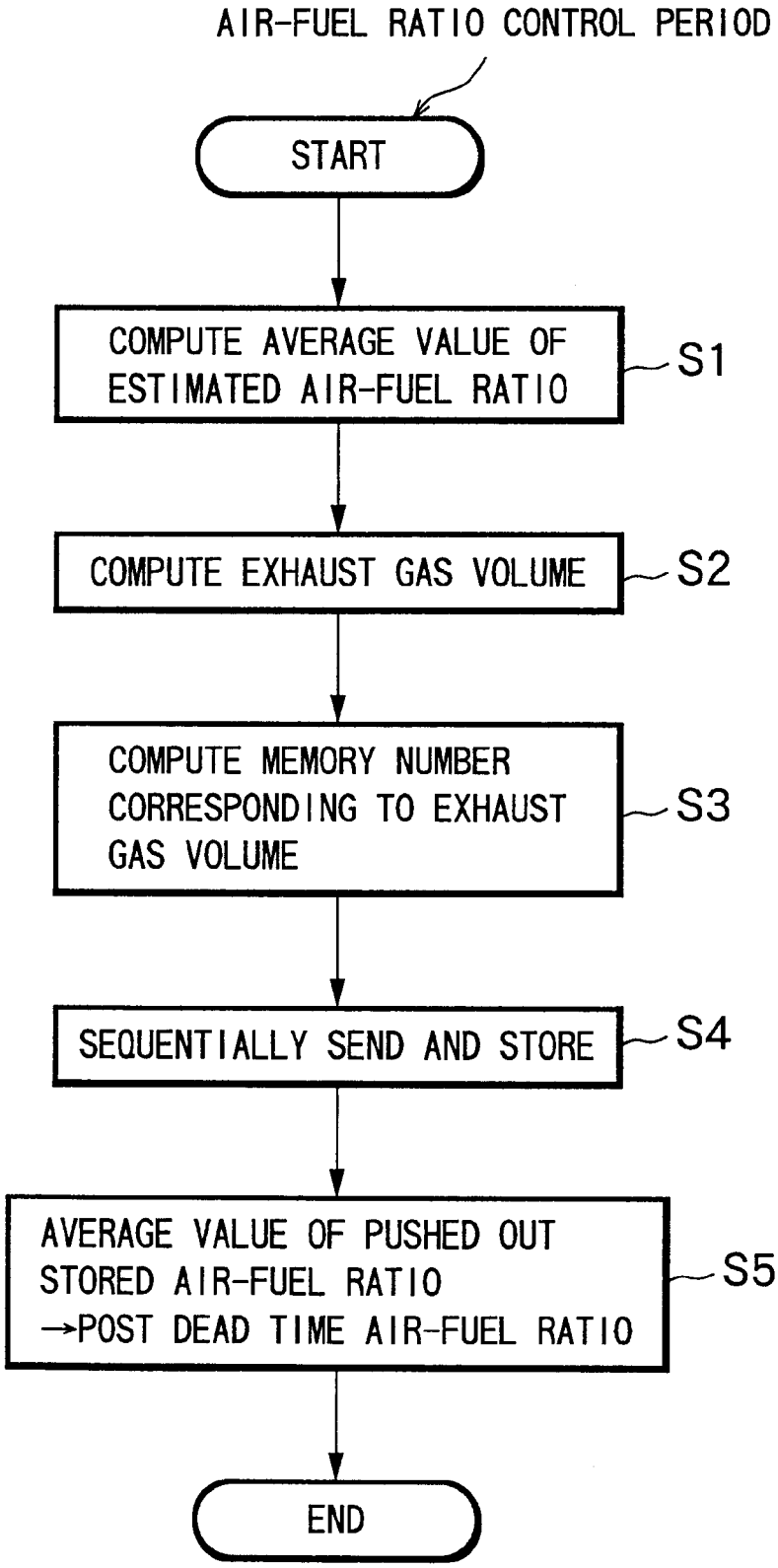
FIG. 8 is a flow chart showing computation of post dead time air-fuel ratio using the memory of FIG. 7.

The procedure in the processing for estimating the air-fuel ratio detected by the air-fuel ratio sensor 27 based on the aforementioned estimated air-fuel ratio (cylinder air-fuel ratio) is shown by the flow chart of FIG. 8.

The flow chart of FIG. 8 is executed for each air-fuel ratio control period. At first, in step S1, the average value of the estimated air-fuel ratios computed during the interval from the time of the previous execution of the routine until the present time is obtained.

Here, in the case where the estimated air-fuel ratio is computed in the same period as the routine, the latest value thereof is read in.

In step S2, the volume of the exhaust gas output from the engine in the interval from the time of the previous execution to the present time is obtained.

More specifically, an average value of the intake air flow (mass flow rate) which is read in as the detection result of the air flow meter 23 at the time of the previous execution, and the intake air flow which is newly read in at the present time, is made an average intake air flow (mass flow rate) in the interval of the latest air-fuel ratio control period, and this average intake air flow is made the mass flow rate of the exhaust gas in the interval of the latest air-fuel ratio control period. Then, this exhaust gas mass flow rate is converted to a volumetric flow rate based on the exhaust gas temperature at that time, and the exhaust gas volume in the interval of the latest air-fuel ratio control period is computed based on volumetric flow rate×air-fuel ratio control period.

The exhaust temperature may be estimated from the engine operating conditions (load, rotation, water temperature, time after starting etc.), or may be detected by an exhaust temperature sensor.

In step S3, the exhaust gas volume is converted to a memory number n by dividing the exhaust gas volume by the divided pipe volume Vx. Numbers after the decimal point of the division result are rounded off to obtain the memory number as an integer.

In step S4, the estimated air-fuel ratio obtained in step S1 is stored in each of the n memories corresponding to the upstream end side, of the memories storing the estimated air-fuel ratios, and the estimated air-fuel ratios stored in the respective memories up to the previous time are shifted by n to the memories corresponding to the downstream side and stored therein (refer to FIG. 7).

In step S5, there is computed the average value of the estimated air-fuel ratios respectively stored in the n memories (refer to FIG. 7) corresponding to the downstream end side which become pushed out from the memories as a result of the updating of the memory storage data in the aforementioned step S4, and this average value is made the estimation value (post dead time estimated air-fuel ratio) of the air-fuel ratio detected by the air-fuel ratio sensor 27 at that time.

The entire contents of Japanese Patent Application No. 2000-206772, filed Jul. 7, 2000 and Japanese Patent Application No. 2000-214174, filed Jul. 14, 2000 are incorporated herein by reference.

What is claimed:

1. A device for feedback controlling an air-fuel ratio of an internal combustion engine comprising:

an air-fuel ratio sensor installed in an exhaust pipe of said engine;

a cylinder air-fuel ratio estimation unit for estimating an air-fuel ratio of an air-fuel mixture formed inside a cylinder of said engine;

an air-fuel ratio detection value estimation unit for estimating an air-fuel ratio detected by said air-fuel ratio sensor, based on the cylinder air-fuel ratio estimated by said cylinder air-fuel ratio estimation unit;

a cylinder air-fuel ratio correction unit for correcting the cylinder air-fuel ratio estimated by said cylinder air-fuel ratio estimation unit, based on the air-fuel ratio estimated by said air-fuel ratio detection value estimation unit and the air-fuel ratio detected by said air-fuel ratio sensor;

an air-fuel ratio correction value computation unit for computing an air-fuel ratio correction value for correcting a fuel injection quantity based on the cylinder air-fuel ratio corrected by said cylinder air-fuel ratio correction unit; and a fuel injection quantity computation unit for computing a fuel injection quantity based on the air-fuel ratio correction value computed by said air-fuel ratio correction value computation unit.

2. A device for feedback controlling an air-fuel ratio of an internal combustion engine according to claim 1, wherein said cylinder air-fuel ratio estimation unit comprises:

a reference air-fuel ratio computation unit for computing a reference air-fuel ratio based on said air-fuel ratio correction value and a target air-fuel ratio;

a fresh air proportion computation unit for computing a fresh air proportion in said cylinder; and a cylinder air-fuel ratio computation unit for computing a cylinder air-fuel ratio based on said reference air-fuel ratio and said fresh air proportion.

3. A device for feedback controlling an air-fuel ratio of an internal combustion engine according to claim 2, wherein said fresh air proportion computation unit computes said fresh air proportion based on volumetric efficiency, atmospheric pressure, intake pressure and compression ratio.

4. A device for feedback controlling an air-fuel ratio of an internal combustion engine according to claim 2, wherein said cylinder air-fuel ratio estimation unit comprises;

a cylinder air-fuel ratio correction unit for correcting the cylinder air-fuel ratio computed by said cylinder air-fuel ratio computation unit based on a dynamic characteristic of said air-fuel ratio sensor.

5. A device for feedback controlling an air-fuel ratio of an internal combustion engine according to claim 1, wherein said air-fuel ratio detection value estimation unit comprises:

an exhaust gas propagation time computation unit for computing a propagation time of exhaust gas from said cylinder to said air-fuel ratio sensor; and an estimation value computation unit for computing an estimation value of air-fuel ratio detected by said air-fuel ratio sensor based on said cylinder air-fuel ratio and said exhaust gas propagation time.

6. A device for feedback controlling an air-fuel ratio of an internal combustion engine according to claim 5, wherein said exhaust gas propagation time computation unit computes said exhaust gas propagation time based on an exhaust pipe volume from said cylinder to said air-fuel ratio sensor, and a volumetric flow rate of exhaust gas.

7. A device for feedback controlling an air-fuel ratio of an internal combustion engine according to claim 1, wherein said cylinder air-fuel ratio correction unit inputs a deviation between the air-fuel ratio estimated by said air-fuel ratio detection value estimation unit and the air-fuel ratio detected by said air-fuel ratio sensor, to a predetermined transfer function to thereby correct said cylinder air-fuel ratio with an output of said transfer function.

8. A device for feedback controlling an air-fuel ratio of an internal combustion engine according to claim 1, wherein said air-fuel ratio detection value estimation unit comprises:

a plurality of memories for storing said cylinder air-fuel ratio respectively corresponding to each divided volume portion for when an exhaust pipe volume from said cylinder to said air-fuel ratio sensor is virtually multiply divided along a flow direction of exhaust gas;

a memory number deciding unit for deciding a number of memories for storing an estimation result of a new cylinder air-fuel ratio based on an exhaust gas volume discharged in an interval of an air-fuel ratio control period;

a sequential storage unit for storing an estimation result for a new cylinder air-fuel ratio in memories corresponding to upstream side divided volume portions according to a decision by said memory number decision unit, and sequentially sending an old estimation result to memories corresponding to downstream side divided volume portions; and an average value computation unit for computing an average value of air-fuel ratio data pushed out from the memories as a result of sequentially sending old data, as an estimation value of air-fuel ratio detected by said air-fuel ratio sensor.

9. A device for feedback controlling an air-fuel ratio of an internal combustion engine according to claim 8, wherein a number of virtual divisions of said exhaust pipe volume corresponding to a number of said plurality of memories is set based on a maximum propagation time of exhaust gas from said cylinder to said air-fuel ratio sensor, and said air-fuel ratio control period.

10. A device for feedback controlling an air-fuel ratio of an internal combustion engine according to claim 8, wherein said memory number deciding unit comprises:

a volumetric flow rate computation unit for computing a volumetric flow rate of exhaust gas based on a mass flow rate of engine intake air and exhaust gas temperature; and an exhaust gas volume computation unit for computing a volume of exhaust gas discharged in an interval of said air-fuel ratio control period based on said exhaust gas volumetric flow rate.

11. A device for feedback controlling an air-fuel ratio of an internal combustion engine comprising:

air-fuel ratio detection means installed in an exhaust pipe of said engine for detecting an air-fuel ratio;

reference air-fuel ratio computation means for computing a reference air-fuel ratio based on an air-fuel ratio correction value and a target air-fuel ratio;

fresh air proportion computation means for computing a cylinder fresh air proportion;

cylinder air-fuel ratio computation means for computing a cylinder air-fuel ratio based on said reference air-fuel ratio and said fresh air proportion;

cylinder air-fuel ratio correction means for correcting said cylinder air-fuel ratio in accordance with a dynamic characteristic of said air-fuel ratio detecting means;

exhaust gas propagation time computation means for computing an exhaust gas propagation time from said cylinder to said air-fuel ratio detecting means;

expected value computation means for computing an air-fuel ratio which is expected to be detected by said air-fuel ratio detection means based on said corrected cylinder air-fuel ratio and said exhaust gas propagation time;

disturbance correction value computation means for computing a disturbance correction value based on the air-fuel ratio computed by said expected value computation means and the air-fuel ratio detected by said air-fuel ratio detection means;

air-fuel ratio correction value computation means for computing an air-fuel ratio correction value based on said target air-fuel ratio, said corrected cylinder air-fuel ratio, and said disturbance correction value; and injection quantity correction means for correcting a fuel injection quantity based on said air-fuel ratio correction value.

12. A device for feedback controlling an air-fuel ratio of an internal combustion engine comprising:

air-fuel ratio detection means installed in an exhaust pipe of said engine for detecting an air-fuel ratio;

reference air-fuel ratio computation means for computing a reference air-fuel ratio based on an air-fuel ratio correction value and a target air-fuel ratio;

fresh air proportion computation means for computing a cylinder fresh air proportion;

cylinder air-fuel ratio computation means for computing a cylinder air-fuel ratio based on said reference air-fuel ratio and said fresh air proportion;

cylinder air-fuel ratio correction means for correcting said cylinder air-fuel ratio in accordance with a dynamic characteristic of said air-fuel ratio detecting means;

a plurality of memories for storing said corrected cylinder air-fuel ratio respectively corresponding to each divided volume portion for when an exhaust pipe volume from said cylinder to said air-fuel ratio detecting means is virtually multiply divided along a flow direction of exhaust gas;

exhaust gas volume computation means for computing a volume of exhaust gas discharged from said engine in an interval of an air-fuel ratio control period;

memory number deciding means for deciding a number of said memories for storing an estimation result of a new cylinder air-fuel ratio based on said exhaust gas volume;

sequential storage means for storing an estimation result of a new cylinder air-fuel ratio from memories corresponding to upstream side divided volume portions according to said decision, and sequentially sending an old estimated air-fuel ratio to memories corresponding to downstream side divided volume portions;

average value computation means for computing an average value of estimated air-fuel ratios pushed out from the memories as a result of old data being sequentially sent by said sequential storage means;

disturbance correction value computation means for computing a disturbance correction value based on the air-fuel ratio computed by said average value computation means and the air-fuel ratio detected by said air-fuel ratio detection means;

air-fuel ratio correction value computation means for computing an air-fuel ratio correction value based on said target air-fuel ratio, said corrected cylinder air-fuel ratio, and said disturbance correction value; and injection quantity correction means for correcting a fuel injection quantity based on said air-fuel ratio correction value.

13. A method of feedback controlling an air-fuel ratio of an internal combustion engine comprising the steps of:

estimating an air-fuel ratio of an air-fuel mixture formed in a cylinder;

estimating an air-fuel ratio detected by an air-fuel ratio sensor installed in an exhaust pipe based on said estimated cylinder air-fuel ratio;

correcting an estimation result of said cylinder air-fuel ratio based on the air-fuel ratio estimated as being detected by said air-fuel ratio sensor and the air-fuel ratio detected by said air-fuel ratio sensor; and computing an air-fuel ratio correction value for correcting a fuel injection quantity based on said corrected estimation result of cylinder air-fuel ratio.

14. A method of feedback controlling an air-fuel ratio of an internal combustion engine according to claim 13 wherein said step of estimating a cylinder air-fuel ratio comprises the steps of:

computing a reference air-fuel ratio based on said air-fuel ratio correction value and said target air-fuel ratio;

computing a cylinder fresh air proportion; and computing a cylinder air-fuel ratio based on said reference air-fuel ratio and said fresh air proportion.

15. A method of feedback controlling an air-fuel ratio of an internal combustion engine according to claim 14, wherein said step of estimating a cylinder air-fuel ratio comprises the step of;

correcting the cylinder air-fuel ratio computed based on said reference air-fuel ratio and said fresh air proportion, based on a dynamic characteristic of said air-fuel ratio sensor.

16. A method of feedback controlling an air-fuel ratio of an internal combustion engine according to claim 13, wherein said step of estimating an air-fuel ratio detected by an air-fuel ratio sensor comprises the steps of:

computing a propagation time of exhaust gas from said cylinder to said air-fuel ratio sensor; and estimating an air-fuel ratio detected by said air-fuel ratio sensor based on said cylinder air-fuel ratio and said exhaust gas propagation time.

17. A method of feedback controlling an air-fuel ratio of an internal combustion engine according to claim 13, wherein said step of correcting an estimation result of said cylinder air-fuel ratio comprises the steps of:

computing a deviation between an air-fuel ratio estimated as being detected by said air-fuel ratio sensor and the air-fuel ratio detected by said air-fuel ratio sensor;

inputting said deviation to a predetermined transfer function; and correcting said cylinder air-fuel ratio with an output of said transfer function.

18. A method of feedback controlling an air-fuel ratio of an internal combustion engine according to claim 13, wherein said step of estimating an air-fuel ratio detected by an air-fuel ratio sensor comprises the steps of:

making a plurality of memories for storing said cylinder air-fuel ratio correspond, respectively, with each divided volume portion for when an exhaust pipe volume from said cylinder to said air-fuel ratio sensor is virtually multiply divided along a flow direction of exhaust gas;

deciding a number of memories for storing a new estimation result based on an exhaust gas volume discharged in an interval of an air-fuel ratio control period;

storing an estimation result for a new cylinder air-fuel ratio from memories corresponding to upstream side divided volume portions according to said decision, and sequentially sending an old estimation result to memories corresponding to downstream side divided volume portions; and computing an average value of air-fuel ratio data pushed out from the memories as a result of sequentially sending old data, as an estimation value of air-fuel ratio detected by said air-fuel ratio sensor.

19. A method of feedback controlling an air-fuel ratio of an internal combustion engine according to claim 18, wherein said step of making a plurality of memories correspond, respectively, with each divided volume portion comprises the step of;

setting a number of virtual divisions of said exhaust pipe volume based on a maximum propagation period of exhaust gas from said cylinder to said air-fuel ratio sensor, and said air-fuel ratio control period.

20. A method of feedback controlling an air-fuel ratio of an internal combustion engine according to claim 18, wherein said step of deciding a number of memories for storing a new estimation result comprises the steps of:

computing volumetric flow rate of exhaust gas based on a mass flow rate of engine intake air and exhaust gas temperature, and computing a volume of exhaust gas discharged in an interval of said air-fuel ratio control period based on said exhaust gas volumetric flow rate.

* * * * *